United States Patent [19]

Tudor

[11] Patent Number: 4,960,209

[45] Date of Patent: Oct. 2, 1990

[54] SHEET STEEL PACKAGE ASSEMBLY

[75] Inventor: Ernest C. Tudor, Highland, Calif.

[73] Assignee: California Steel Industries, Inc., Fontana, Calif.

[21] Appl. No.: 324,582

[22] Filed: Mar. 16, 1989

[51] Int. Cl.[5] ..... B65D 19/06; B65D 6/00

[52] U.S. Cl. ..... 206/597; 206/451; 206/600; 108/53.1

[58] Field of Search ..... 206/449, 451, 454, 386, 206/499, 597, 600; 220/4 A, 4 B, 1.5; 108/53.1, 53.3, 53.5, 55.1, 56.1, 56.3; 229/23 R

[56] References Cited

U.S. PATENT DOCUMENTS

| | | | |
|---|---|---|---|
| 801,566 | 5/1969 | Rissberger, Jr. et al. | 206/454 |
| 2,176,284 | 7/1938 | Whiteford | 206/454 |
| 2,447,677 | 8/1948 | Williams | 229/23 R |
| 2,534,010 | 12/1950 | Frye | 229/23 R |
| 3,438,488 | 4/1969 | Rohde | 206/597 |
| 3,622,063 | 11/1971 | McVeigh | 229/23 R |
| 3,968,895 | 7/1976 | Barnes, Jr., et al. | 108/55.1 |
| 4,030,600 | 6/1977 | Heaps | 206/597 |
| 4,266,670 | 5/1981 | Mykleby | 206/600 |
| 4,674,645 | 6/1987 | Instone et al. | 206/600 |
| 4,697,731 | 10/1987 | Snyder | 229/23 R |

*Primary Examiner*—Paul T. Sewell
*Assistant Examiner*—Jacob K. Ackun, Jr.
*Attorney, Agent, or Firm*—Christie, Parker & Hale

[57] ABSTRACT

A package for shipping stacks of sheet steel has a bottom tray which has three upstanding side walls and is open at one end. An L-shaped end cap fits outside the tray and provides an end wall for engaging an end of a stack of steel sheets in the tray. A rectangular cover fits over the tray and end cap for closing the package. A vinyl liner inside the steel package for further protecting the steel sheets from corrosion. The tray is stiffened in a lengthwise direction by timbers inside the tray under the stack of sheets, and on the outside by crosswise timbers which also permit access by a forklift or crane. The package is held rigid by steel straps encompassing the package.

18 Claims, 3 Drawing Sheets

SHEET STEEL PACKAGE ASSEMBLY

FIELD OF THE INVENTION

This invention relates to a lightweight, easily manufactured and easily utilized package assembly in which sheet steel may be packaged to provide improved protection against damage during shipping.

BACKGROUND OF THE INVENTION

It is often necessary to ship precut sheet steel overseas to foreign purchasers and manufacturers. Such shipping requires that the steel be produced in a form amenable to packaging and further requires that the packaging provide protection against corrosion damage that may occur as a result of exposure to moisture.

Sheet steel emerges from the production mill in the form of a long single sheet which is coiled into a roll. When the steel is to be packaged for shipping, a roll is transported to the cutting area and loaded onto a spooling and cutting device. A portion of the roll is played out and a shear descends to cleave a rectangular sheet of steel from the roll. The playing out and shearing process is performed in a continuous motion such that many sheets of steel are cut from each roll. Running speeds of such a shear line often approximate 350 feet of steel per minute.

Typically, as each sheet is cut from the roll it is carried along a conveyor belt via motorized conveyor rollers to the packaging area. At the packaging area each sheet passes beneath an overhanging conveyor belt assembly capable of being magnetized so as to lift each sheet from the conveyor roller assembly and secure it to the overhanging belt. The overhanging belt then transports each sheet until it is positioned over a piling device, further described below. The overhanging belt is then demagnetized such that the sheet steel is released, and the forward and downward motion of the sheet carries it into the piling device below. In this way, a number of steel sheets are stacked on top of each other in the piling device.

The piling device provides a means for straightening the stack of steel sheets prior to packaging such that the edges of all the sheets are aligned with each other. The device comprises a rectangular base portion upon which the stack of sheets rests, the base having planar dimensions roughly similar to those of a steel sheet. Rollers may be incorporated into the base to facilitate removing a completed stack from the piling device. Five moveable straightening rams are arranged around the base and extend upward perpendicular to the plane base. Two of the moveable rams are spaced along each opposing long side of the base and a single ram is positioned at the center of one shorter side. At the other shorter side of the base is located a stationary vertical wall.

The straightening rams serve two purposes. First, they act as guides for the steel sheets as they drop from the overhanging conveyor assembly to the base. The sheet's forward motion as it drops from the moving overhead conveyor assembly causes one shorter end of the sheet to strike the end movable ram. The forward motion of the sheet is arrested and it drops to the stack, the moveable rams roughly aligning the sheets on top of each other.

Second, each moveable ram is pneumatically driven in a reciprocating motion perpendicular to its corresponding side of the base so as to contact the edges of the stack of steel sheets. Thus, the stack is straightened along the long edges by the synchronously opposing and compressing motion of the two sets of straightening rams located along the long side of the base. The stack is straightened along the short end by the motion of the single straightening ram located along the short end. This ram forces the stack to abut against the stationary wall, causing the short edges of the individual sheets to align with each other. Thus, the action of the moveable rams in conjunction with the stationary wall works to produce a stack of steel sheets sufficiently aligned for packaging.

In some prior art packaging assemblies the packaging process begins in the piling device. Prior to any introduction of steel sheets into the device a heavy paper lining, substantially larger than the steel sheets, and sometimes treated with corrosion resistant chemicals, is placed on the base of the piling device. Steel sheets are then stacked on top of the lining as above described. When the stack contains the proper amount of sheets the stack and lining combination is removed from the piling device. The lining is then folded up and around the sides and top of the stack and sealed. Thus, the lining completely encloses the stack of steel sheets. To provide stiffness to the stack, laborers then apply a piece of angle iron to each of the twelve edges of the lined stack and join together the fasten steel straps around the bundle and pieces of iron. The straps also secure the bundle to underlying 4×4 timbers which permit the bundle to be handled by a forklift. The assembly as described is then shipped, often overseas.

Significant drawbacks attend such a package assembly. The vast majority of the surface area of the stack is covered only by the thin paper lining, which is highly susceptible to puncture or tearing. A puncture hole can allow moisture to contact the stack, causing corrosive damage that the lining is meant to prohibit. The possibility of puncture is heightened by the lack of structural stiffening of the stack prior to and during the application of the angle iron. The lack of stiffening may allow the stack to become skewed during handling. Such skewing causes sharp edges and corners of sheets within the stack to protrude and contact the paper lining, causing punctures to occur.

Further, the application of the angle iron to the stack is a time consuming, labor intensive task, which uses relatively expensive material. Packaging costs under this method typically approximate 35 to 40 dollars per ton. Also, the resultant uneven package exterior detracts from the ability to stack the packages stably on top of each other, and further, renders the package more susceptible to damage by inadvertently catching the protruding angle iron on another package or other object.

Thus, it is desirable to provide a package assembly for stacked sheet steel which is more protective and more manageable, while also being lighter in weight, less expensive, less labor intensive, and less susceptible to damage than the existing assemblies.

The present invention fulfills these needs. The package fully encloses the steel sheet stack with rigid material, such as low grade steel, which is difficult to inadvertently penetrate. The invention provides stiffening of the stack from the beginning of the stacking process, and is extremely easy and inexpensive to assemble. The packaging cost using the invention is reduced to approximately 15 dollars per ton, as compared to the 35 to 40 dollars per ton cost of previous packages. The exterior surfaces of invention are uniform and very amenable to stable stacking of packages.

SUMMARY OF THE INVENTION

One embodiment of this invention provides a package assembly for packaging stacks of sheet steel stock, for shipping overseas, for example. The assembly comprises a broad flattened tray for receiving a plurality of sheets of steel stock, the tray having three upstanding sides and one open side. The invention further comprises a top cover, having four downwardly extending sides, which attaches to the top of the tray to fully enclose the interior of the tray. Supplemental to the above embodiment is a side cover, which attaches to the tray along the open side of the tray prior to attachment of the top cover. A U-shaped removable guide may be employed to assist in the stacking of the steel sheets within the tray. Stiffening members may be arranged in a lattice arrangement between the bottom of the steel stack and the tray to provide stiffening of the completed package assembly. Spacing members may be attached on the outside of the bottom of the tray to provide for easy lifting of the assembly.

DETAILED DESCRIPTION

Figure 1:
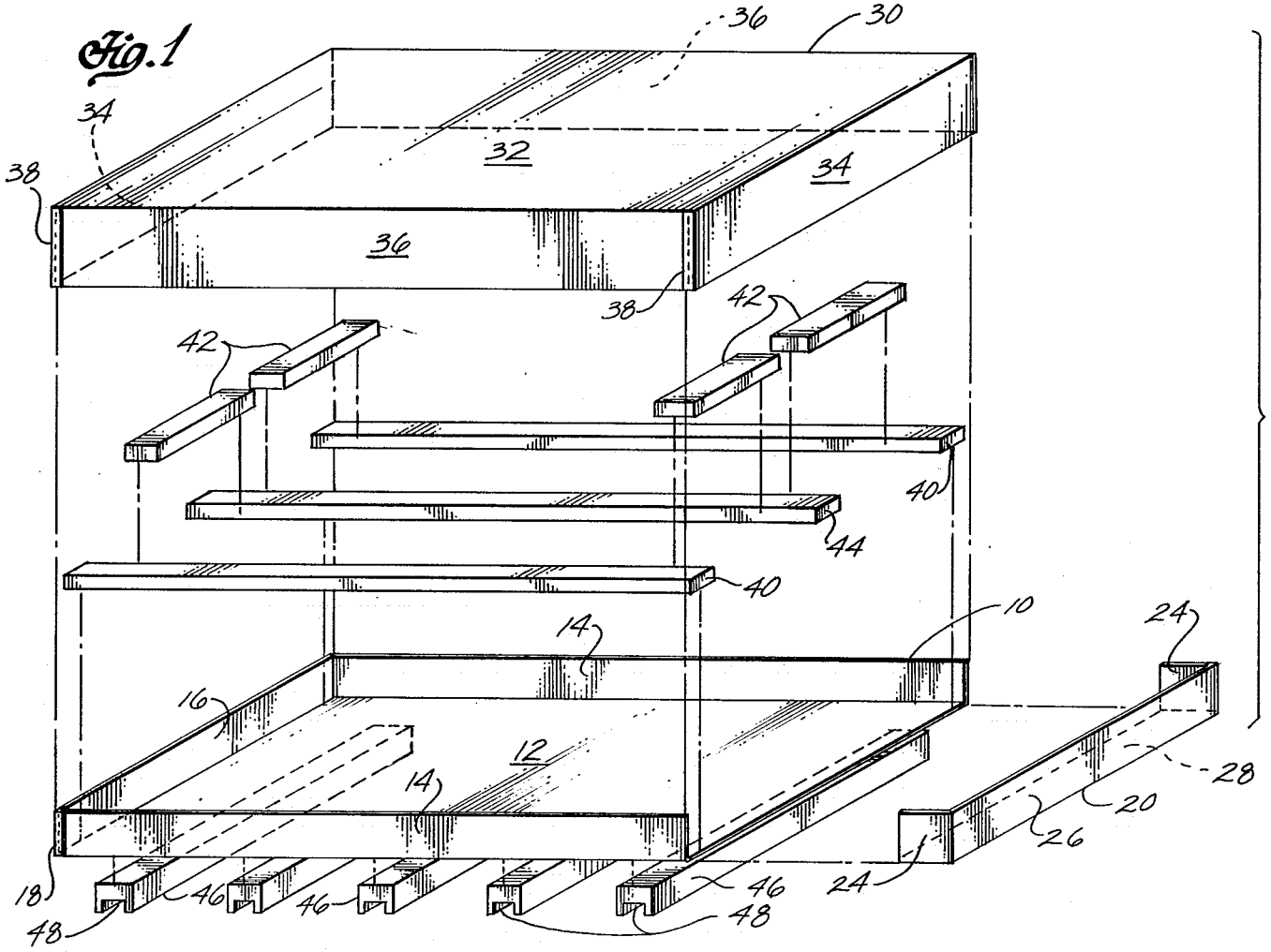
FIG. 1 is an exploded view of the components of a sheet steel package assembly.

The steel sheet package assembly is designed to protectively enclose stacks of sheet steel for shipment. In this embodiment a rectangular tray 10 serves as the receptacle into which sheets of stock steel are deposited as they emerge from the uncoiling and shearing line. The tray is formed from a single sheet of steel which is commonly known as "secondary material," that is, steel that for some reason does not meet customer specifications but is still quite usable for other lower grade purposes. The secondary material sheet is cut to allow two longer sides 14 and one shorter side 16 to be folded up to a position perpendicular to the tray bottom 12, while leaving one side of the tray open. In this embodiment when the shorter side is folded to its upright position, each end of the shorter side extends beyond an edge of the longer side 14. These extensions form tabs 18 which are creased around the longer sides and spot welded to the longer sides, forming reinforced corners of the tray. These corners could, of course, be created by cutting tabs on each of the longer sides and folding and spot welding the tabs to the shorter side. All three sides extend to an exemplary height of 13 centimeters from the tray bottom 12. The tray bottom is of similar dimensions to, but minimally larger than, a sheet of steel which the tray encloses, approximately two meters long by one meter wide for example. The upstanding tray sides are of corresponding lengths.

An L-shaped end cover 20 is similarly constructed from a single piece of secondary material. The end cover has a base 28 that is horizontal when in use, with a length approximately equal to, but minimally longer than, the shorter side of the tray, here approximately one meter. The width of the base 28 is fifteen centimeters, for example. Two shorter sides 24 and one longer side 26 extend upwardly approximately fifteen centimeters from the base. When the end cover 20 is in use it is seated against the open end of the tray. The base 28 and shorter sides 24 of the cover 20 slidably engage the exterior of the tray bottom 12 and the longer tray sides 14, respectively. The cover is longer side 26 is flush with the open edges of the longer sides 14 and bottom 12 of the tray, and thus encloses the one open side of the tray.

A top cover is formed in a manner similar to that of the tray and side cover. A single piece of secondary material is cut to allow two top cover longer sides 36 and two top cover shorter sides 34 to be folded downward from the top upper face 32. Similarly to the bottom tray construction, tabs 38 are formed to be folded over and spot welded to form reinforced corners of the top cover. The sides of the top cover descend to a exemplary depth of approximately 25 centimeters from the top 32. Thus, it will be noticed that the depth of the top cover 32 exceeds the height of the tray 10 by approximately 12 centimeters.

When in use the sides 34, 36 of the top cover slidably engage the combination of the tray and the end cover 20 along the exterior of the three tray sides 14, 16 and the end cover side 26. When so engaged the top cover completely encloses the interior of the tray and constrains the end cover to its seated position against the open end of the tray. It should be noted that the greater top cover depth relative to the tray height allows for complete enclosure even for stacks of steel sheets which extend significantly higher than the tray height. The exemplary configuration here described can effectively enclose a steel stack with height ranging from about 18 centimeters to 28 centimeters. A deeper cover may be used for higher stacks, if desired, but generally larger stacks may be too heavy to handle conveniently.

Lengthwise stiffening members are enclosed within the tray to inhibit lengthwise bending of the package during packaging, loading, and transport. Such package rigidity greatly facilitates handling and lessens the possibility that the enclosed steel stack will become skewed within the package. In this embodiment stiffening is partly accomplished using three lengthwise members 40 and four crosswise spacers 42. The lengthwise members are wooden two-by-fours of length approximately equal to, but minimally shorter than, the length of the tray 10. The lengthwise members are placed on the bottom of the tray, two of the three members 40 being positioned within the tray to abut lengthwise against opposite tray longer sides 14. The third member 44 is placed lengthwise on the bottom of the tray at a point equidistant between the other two stiffening members 40. The crosswise spacers 42 are of a length equal to the distance between the middle lengthwise member 44 and the end lengthwise members 40. The four crosswise spacers are placed between the lengthwise members as shown in FIG. 1 and act as braces to constrain the lengthwise members to their original locations. Further constraint of the stiffening members is provided by the steel sheets stacked on top of the stiffening arrangement. The stiffening members are thus rendered immobile relative to the tray and provide rigidity in the lengthwise direction as well as some rigidity in the crosswise direction.

Additional rigidity in the crosswise direction is accomplished by a five spacing members 46. The spacing members are wood four-by-fours of a length approximately equal to the width of the tray 10. Such spacing members extend across the width of the tray bottom 12 exterior at intervals along the length of the tray 10. Each member has a squared-off groove 48 extending down the center of one long side of the member. The groove has a depth sufficient to receive one of several steel restraining bands 66 (FIG. 3) which encircle the package width-wise and hold the spacing members in place against the bottom of the tray 10. The spacing members provide crosswise rigidity to the package. Further, when stored and shipped the package rests on the spacing members, allowing access to the bottom of the package for forklifts and cranes.

Steel straps 67 are placed around the length of the bundle as well. Collectively the straps tightly secure the tray and cover to the enclosed stack of steel sheets. Racking and twisting are prevented by the tray, cover and straps. The timbers inside and outside the tray prevent bending. The encompassing steel protects the vinyl from damage. The cover over the outside of the tray keeps water from getting into the package.

Figure 2:
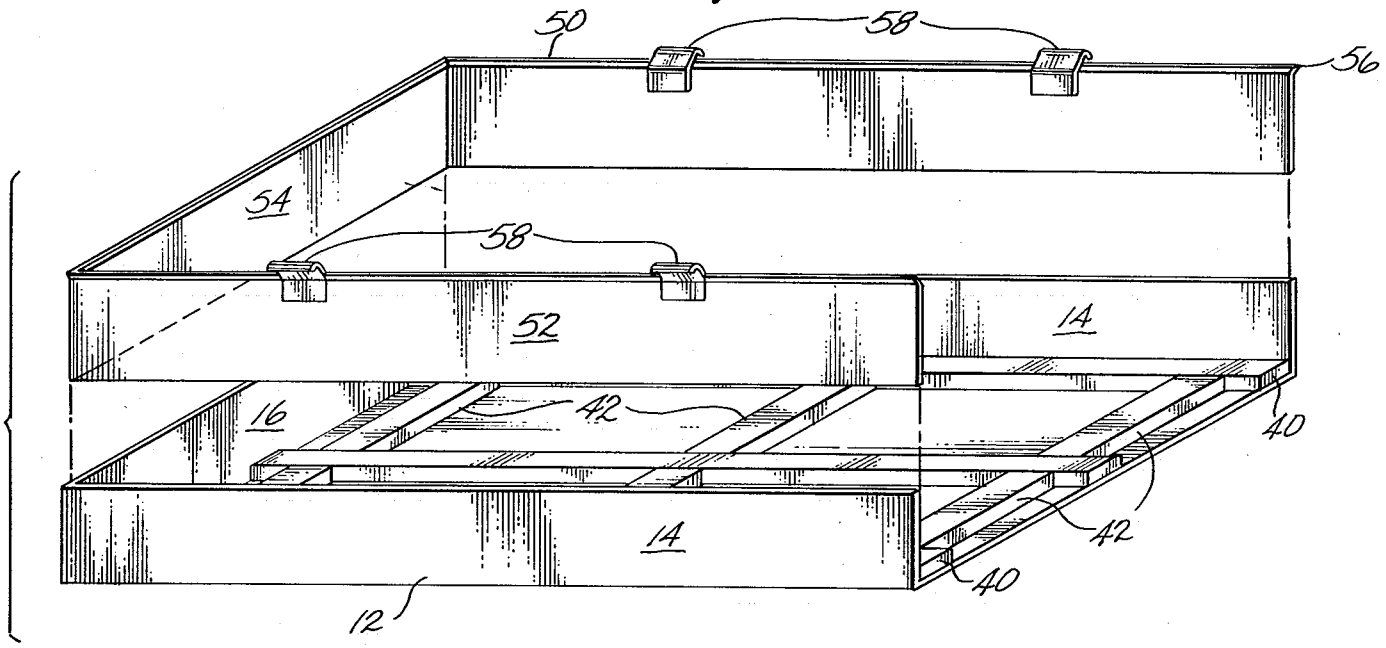
FIG. 2 is an isometric view of a guide with an indication of how it interacts with the tray during the piling process.

FIG. 2 illustrates a removable U-shaped guide 50 which is used to allow stacking of steel sheets within the tray to a height greater than that of the sides of the tray. The guide is a rectangular frame having one open side and three upstanding sides 52, 54 of height greater than that of the tray sides, 25 centimeters, for example. The two guide longer sides 52 are here of length approximately equal to that of the tray longer side 14, and the guide shorter side 54 is approximately equal to, but minimally shorter than that of the tray shorter side 16. The top 56 of each upstanding side 52, 54 of the guide is bent outwardly beginning at a point approximately one centimeter from the top edge, at an angle of approximately 30 degrees. A plurality of handle tabs 58, here shown numbering two on each side, extend outward diagonally from the top of each long side 52 of the guide. The tabs are used as handles to facilitate removal of the guide from the tray after the tray has been filled with steel sheets.

When employed, the guide is inserted into the tray as the tray rests in the piling device. The guide is oriented as shown in FIG. 2, with the open side of the guide corresponding to the open side of the tray.

The tray 10, containing the stiffening members 40, 42, 44, is placed directly onto the base of a standard sheet piler as described in the background of the invention. The tray is oriented such that the end movable ram of the piling device is located at the open side of the tray and guide midway between the longer sides 14 of the tray. The other four moveable straightening rams of the piling device are along the opposite long sides of the tray and guide, two being spaced along each longer side. The stationary wall is at the closed end of the tray and guide. The steel sheets travel over this wall when entering the piler.

A lining sheet, made of film vinyl impregnated with corrosion inhibiting chemicals, and having dimensions substantially larger than those of the tray bottom, is then placed on top of the stiffening members in the tray. The excess lining extends over the edges of the tray. A single protective secondary material steel sheet is placed in the tray on the lining.

The guide is then set into the tray, resting atop the vinyl sheet and the stiffening timbers. The open end of the guide is at the open end of the tray adjacent to the end moveable ram of the piler. The film vinyl passes out of the tray between the tray walls and the guide walls. Thus, with the guide inserted, the edges of the steel sheets do not contact the film vinyl during the stacking and straightening process, during which the vinyl would otherwise be susceptible to damage. Further, as the sides of the guide extend upward higher than the sides of the tray, a higher stack of steel may be created and straightened than without the guide. The outwardly flared tops of the sides act to decrease the possibility that a sheet may perch atop the guide itself. The guide is of thin elastically flexible material and will thus not inhibit the straightening action of the movable straightening rams of the piling device.

By having one end of the tray and guide open, the stack straightening rams in the piler can engage all of the sheets and make a neat stack with the edges of all the sheets aligned. The alignment is facilitated by the guide which engages the other three sides of the stack for its full height, thereby avoiding ragged corners which can tear the vinyl.

As previously mentioned, sheets of steel approach the piling device while suspended from an overhanging magnetic conveyor. The sheets travel in a direction such that they pass over the shorter side 16 of the tray and the end of the guide as they rest in the piling device. At the point where the sheet is positioned almost directly over the tray, the sheet conveyor is demagnetized. The sheet is released and drops downwardly and forwardly, and its forward motion is arrested when its forward edge hits the endwise movable ram in the piler (not shown). The rearward edge then drops into the tray, the sheet bows lengthwise somewhat, and then the front edge slaps down into the tray. Any air between the first sheet and the bottom of the tray, or between subsequent sheets, escapes out of the open side of the tray, thereby eliminating any air pockets upon which the sheets might slide.

As the sheets are falling into the tray, the movable straightening rams of the piling device are moving in a reciprocating motion against the three sides of the tray to straighten the sheets as they are stacked The sides of the tray and guide are sufficiently pliant that the force of the straightening rams is translated to the sides of the steel stack, thereby aligning the individual sheets.

After the required number of steel sheets have been stacked and straightened in the tray, the tray exits the piler laterally, perhaps facilitated by rollers incorporated into the base. The guide is then removed, being lifted out of the tray by the handle tabs 58. A top secondary material steel sheet is placed on top of the stack, and the edges of the film vinyl are folded up and around the top of the stack and the bundle closed with tape. The end cover 20 is applied to the open side of the tray, and the top cover 30 is applied over the tray and end cover combination. Spacing timbers 46 are located along the bottom of the tray and timber each secured to the tray by a steel strap 66 encircling the spacing member and the other elements of the package assembly.

Figure 3:
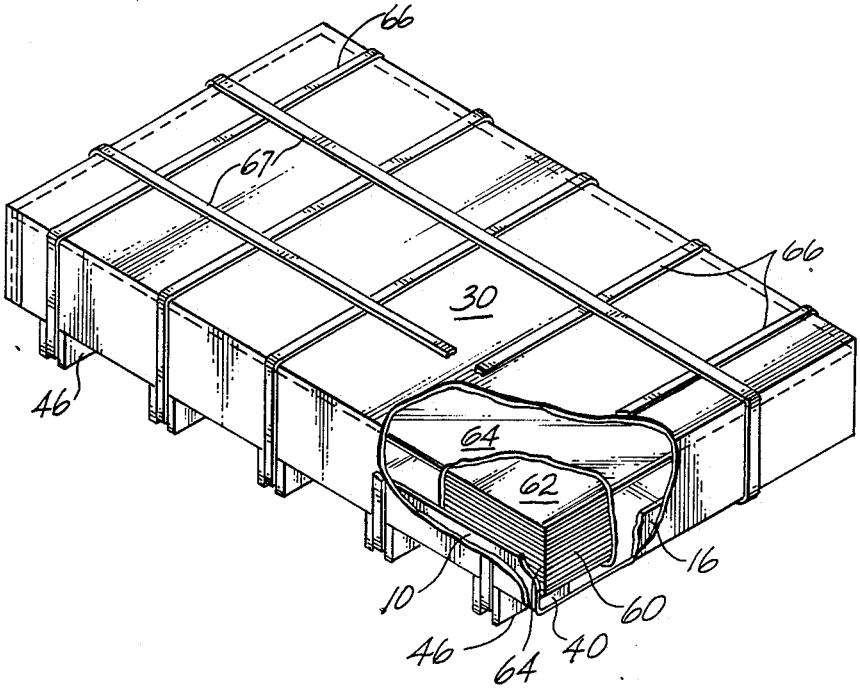
FIG. 3 is an isometric view of a completely assembled package, with one package corner cutaway.

FIG. 3 illustrates the completely assembled package and also shows a cutaway view of one corner of the package. The shorter side of the package exposed by the cutaway is the side opposite that of the location of the end cover. A stack of steel sheets 60, having secondary material sheets 62 on top and bottom, is enclosed by the film vinyl 64. The vinyl wrapped stack is on top of the stiffening members 40 in the tray 10 and constrained by the tray shorter side 16 and longer side 14. The height of the stack is greater than the height of the tray sides 14, 16. The top cover 30 surrounds the stack and the tray sides. Spacing members 46 are shown secured to the package by metal bands 66.

Thus, the invention provides a sheet steel package assembly which is more protective and more manageable, while also being lighter in weight, less expensive, less labor intensive, and less susceptible to damage than the existing assemblies.

Many modifications and variations of the packaging assembly are feasible within the scope of this invention. For example, the invention may be practiced without employing the side cover, relying instead on one short side of the top cover to enclose the open side of the tray during shipping. One might choose to have both ends of the tray open. Also, a variety of guide designs are possible.

The top cover, side cover, tray, and guide components of the package may be constructed in varying dimensions, according to the dimensions of the steel sheets to be packaged. The components may also be constructed of a variety of different materials, such as aluminum, for example. Many similar changes will be apparent and it is therefore to be understood that this invention may be practiced otherwise than as specifically described.

What is claimed is:

1. A sheet steel packaging arrangement comprising:

a rectangular tray for receiving a plurality of sheets of steel, the tray having a bottom, an open top, a plurality of enclosed sides and at least one open side;

a top cover slidably engaging the tray for completely enclosing the open portions of the tray; and at least one L-shaped side cover, each such side cover slidably engaging the bottom and an open side of the tray for enclosing each open side of the tray and fitting inside the top cover.

2. A packaging assembly according to claim 1 including removable U-shaped guide means for guiding the sheets into the tray prior to engagement of the top cover to the tray.

3. A packaging assembly according to claim 1 including means for stiffening the tray in the lengthwise direction, such stiffening means being located within the tray and engaging the bottom of the tray.

4. A packaging assembly according to claim 1 including crosswise members for supporting the tray at an elevated position to provide spacing between the tray and a supporting structure and stiffening the tray in a crosswise direction.

5. A packaging assembly for packaging sheet steel comprising:

a rectangular tray having a bottom, an interior, and an exterior, the tray being open at the top, enclosed on each of three sides by an upstanding sidewall, and having one unenclosed side;

a tray end cover for engaging the tray along the bottom and the unenclosed side;

a rectangular top cover for covering the top of the combination of the tray and end cover;

a U-shaped guide for guiding the steel sheets into the tray prior to engagement of the top cover and end cover to the tray;

said guide removably engaging the interior of the tray during packaging of steel sheets.

6. A packaging assembly according to claim 5 wherein the guide means comprises a rectangular frame having one open side and three upstanding sides of height greater than the height of the tray sidewalls.

7. A packaging assembly according to claim 5 wherein the top cover has a cover top wall and four cover sidewalls, each cover sidewall having a height greater than that of each of the tray sidewalls.

8. A packaging assembly according to claim 5 including a plurality of lengthwise stiffening members resting against the interior bottom surface of the tray.

9. A packaging assembly according to claim 5 including a plurality of crosswise stiffening members engaging the exterior bottom surface of the tray.

10. A packaging assembly for packaging sheet steel comprising:

a rectangular tray having a bottom, an interior, and an exterior, the tray being open at the top, enclosed on each of three sides by an upstanding sidewall, and having one unenclosed side;

a tray end cover for engaging the tray along the bottom and the unenclosed side;

a rectangular top cover for covering the top of the combination of the tray and end cover;

said tray end cover comprising an elongated L-shaped rectangular casting having a length conforming to the unenclosed side of the tray, open along two elongated sides and closed at each opposing end.

11. A sheet steel and package combination comprising:

a stack of rectangular steel sheets, the stack having a top, a bottom, and four sides;

a rectangular bottom tray for enclosing the bottom of the stack and partially enclosing only three of the four sides of the stack;

means for partially covering the fourth side of the stack, such side covering means fitting outside the tray; and a rectangular cover for covering the top of the stack and enclosing at least those portions of the sides of the stack not enclosed by the bottom tray and the fourth side covering means.

12. The combination according to claim 11 including stiffening timbers located between the bottom of the tray and the bottom of the stack.

13. The combination according to claim 11 including a weatherproof liner inside the tray and cover, and fully encompassing the stack of steel sheets.

14. The combination according to claim 11 including a plurality of straps encompassing the combination for holding the assembly intact.

15. A sheet steel and package combination comprising:

a stack of rectangular steel sheets, the stack having a top, a bottom, and four sides;

a rectangular box shaped tray having a bottom, one open side, and three closed sides which are sufficiently high for partially enclosing the stack;

a side cap fitted over the tray at the open side for partially enclosing the stack at the open side of the tray;

a top cover having a top face and four downwardly extending sidewalls for engaging the combination of the stack, tray and side cap, and for enclosing the portion of the stack not enclosed by the tray or the side cap;

a plurality of lengthwise stiffening members arranged in a lattice between the bottom of the stack and the bottom of the tray;

a plurality of crosswise stiffening members engaging the tray from below the tray; and a plurality of restraining straps encircling the combination of the stack, tray, side cap, top cover, and stiffening members.

16. A sheet steel packaging arrangement comprising:

a rectangular tray for receiving a plurality of sheets of steel, the tray having a bottom, an open top, a plurality of enclosed sides and at least one open side;

a top cover slidably engaging the tray for completely enclosing the open portions of the tray; and at least one L-shaped side cover, each such side cover slidably engaging the bottom and an open side of the tray for enclosing each open side of the tray and fitting inside the top cover.

17. A packaging assembly for packaging sheet steel comprising:

a rectangular tray having a bottom, an interior, and an exterior, the tray being open at the top, enclosed on each of three sides by an upstanding sidewall, and having one unenclosed side;

a tray end cover for engaging the tray along the bottom and the unenclosed side;

a rectangular top cover for covering the top of the combination of the tray and end cover; and wherein the tray end cover comprises an elongated L-shaped rectangular casing having a length conforming to the unenclosed side of the tray, open along two elongated sides and closed at each opposing end.

18. A packaging assembly for packaging sheet steel comprising:

a rectangular tray having a bottom, an interior, and an exterior, the tray being open at the top, enclosed on each of three sides by an upstanding sidewall, and having one unenclosed side;

a tray end cover for engaging the tray along the bottom and the unenclosed side; and a rectangular top cover for covering the top of the combination of the tray and end cover;

U-shaped guide means for guiding the steel sheets into the tray prior to engagement of the top cover and end cover to the tray, said guide means removably engaging the interior of the tray during packaging of the steel sheets.

* * * * *